US005423254A

United States Patent [19]

Kimura et al.

[11] Patent Number: 5,423,254

[45] Date of Patent: Jun. 13, 1995

[54] IMAGE-TRANSFER APPARATUS WITH HIGHLY ACCURATE REGISTERING PERFORMANCE

[75] Inventors: Takayuki Kimura; Arata Imabayashi, both of Tokyo, Japan

[73] Assignee: Toyo Ink Manufacturing Co., Ltd., Tokyo, Japan

[21] Appl. No.: 155,287

[22] Filed: Nov. 22, 1993

[30] Foreign Application Priority Data

| | | | |
|---|---|---|---|
| Jan. 8, 1993 | [JP] | Japan | 5-018249 |
| Mar. 18, 1993 | [JP] | Japan | 5-058831 |
| Mar. 18, 1993 | [JP] | Japan | 5-058832 |

[51] Int. Cl.[6] ..... B41F 5/22; B41F 13/30

[52] U.S. Cl. ..... 101/217

[58] Field of Search ..... 101/247, 216, 212, DIG. 41, 101/228, 217, 218, 137, 140, 177

[56] References Cited

U.S. PATENT DOCUMENTS

| | | | |
|---|---|---|---|
| 542,369 | 7/1895 | Meisel | 101/216 |
| 2,036,835 | 4/1936 | Sites . | |
| 2,301,379 | 11/1942 | Davis | 101/248 |
| 3,129,662 | 4/1964 | Pinkerton | 101/218 |
| 3,407,727 | 10/1968 | Fischer . | |
| 5,075,722 | 12/1991 | Adolphson et al. . | |

FOREIGN PATENT DOCUMENTS

| | | | |
|---|---|---|---|
| 601315 | 2/1926 | France . | |
| 2802153 | 7/1979 | Germany | 101/DIG. 41 |
| 1163977 | 9/1969 | United Kingdom . | |

OTHER PUBLICATIONS

Patent Abstracts of Japan, Apr. 14, 1987, vol. 11, No. 285, P-616, *Image Transfer Device.*

Patent Abstracts of Japan, Jun. 3, 1991, vol. 15, No. 344, P-1245, *Image Forming Device and Superimposed Printing Method.*

Patent Abstracts of Japan, Jul. 20, 1992, vol. 16, No. 532, P-1448, *Image Transfer Method.*

*Primary Examiner*—J. Reed Fisher

*Attorney, Agent, or Firm*—Wenderoth, Lind & Ponack

[57] ABSTRACT

An image-transfer apparatus performs highly accurate registering and comprises a platen having a cut-off portion on its surface, being prepared for attaching an image-forming material thereto, and a transfer cylinder having a cut-off portion on the surface being prepared for attaching an image receptor thereto. The apparatus allows the introduction of an image-forming material and an image receptor into a nip formed by the platen and the transfer cylinder by the rotation of the platen and the transfer cylinder to transfer an image formed in a photosensitive layer of the image-forming material to the image receptor. The image-transfer apparatus further has a printing pressure adjusting device for adjusting the movement of the platen towards the axial center of the transfer cylinder or the movement of the transfer cylinder towards the axial center of the platen, and two first gears which rotate the platen and the transfer cylinder with an actuation mechanism. One of the first gears is positioned coaxially with the rotation axis of the platen, and the other of the first gears is positioned coaxially with the rotation axis of the transfer cylinder.

16 Claims, 5 Drawing Sheets

IMAGE-TRANSFER APPARATUS WITH HIGHLY ACCURATE REGISTERING PERFORMANCE

FIELD OF THE INVENTION

The present invention relates to an image-transfer apparatus. More specifically, it relates to an image-transfer apparatus having a platen and a transfer cylinder which provides a fine multi-color prepress proof and a multi-color print with highly accurate registering performance.

PRIOR ART OF THE INVENTION

As proof sheets, single-color and multi-color prepress proof sheets have been increasingly produced by imagewise exposing photosensitive layer(s) of image-forming material(s) to form image(s) and transferring the image(s) to an image receptor under heat, generally around 100° C. The image-forming material is generally formed of a substrate, a photosensitive layer (formed on one surface of the substrate) and a protection film. The substrate and the protection film are selected from thin films or sheets formed from a material such as cellulose acetate, polystyrene, polyvinyl chloride or polyethylene terephthalate. The image receptor is selected from paper and a film.

For producing the above prepress proof sheet, there has been proposed an image-transfer apparatus which mainly has a platen to which an image-forming material is to be attached and a transfer cylinder to which an image receptor is to be attached. In producing a prepress proof sheet with this image-transfer apparatus, the platen and the transfer cylinder are rotated so that a photosensitive layer of the image-forming material and an image receptor are brought into contact with each other under pressure, whereby an image formed in the photosensitive layer is transferred to the image receptor in a nip portion formed by the platen and the transfer cylinder. A multi-color print or prepress proof sheet is produced by color-scanning an original of a multi-color image, imagewise exposing image-forming materials corresponding to separated colors, e.g., yellow, magenta, cyan and black, to form images of these colors in the image forming materials (one image of one color in one image-forming material), and consecutively transferring these formed images to one image receptor.

For attaching the image-forming material to the platen, a pin bar is generally used, facilitating the registering of each color. The pin bar has a structure in which a plurality of pins are provided on a plate extending in the axial direction of the platen. However, the registering accuracy with the pin bar has not yet been fully satisfactory.

SUMMARY OF THE INVENTION

It is an object of the present invention to provide an image-transfer apparatus which can provide a multi-color prepress proof sheet or a multi-color print whose registering accuracy is fully satisfactory.

It is another object of the present invention to provide an image-transfer apparatus which can provide a multi-color prepress proof sheet or a multi-color print that is fully satisfactory in registering accuracy in transferring images formed in photosensitive layers of image-forming materials to an image receptor.

According to the present invention, there is provided an image-transfer apparatus which comprises a platen having a cut-off portion on the surface thereof and being prepared for attaching an image-forming material thereof and a transfer cylinder having a cut-off portion on the surface thereof and being prepared for attaching an image receptor. The apparatus allows the introduction of the image-forming material and the image receptor into a nip formed by the platen and the transfer cylinder by the rotation of the platen and the transfer cylinder to transfer an image formed in a photosensitive layer of the image-forming material to the image receptor.

The image-transfer apparatus further has a printing pressure adjusting means for adjusting the movement of the platen towards the axial center of the transfer cylinder or the movement of the transfer cylinder towards the axial center of the platen and two first gears which rotate the platen and the transfer cylinder with an actuation means. One of the first gears is positioned coaxially with the rotation axis of the platen, and the other of the first gears is positioned coaxially with the rotation axis of the transfer cylinder.

Further, according to the present invention, there is provided an image-transfer apparatus having the above constitution, wherein one of the first gears, positioned coaxially with the rotation axis of the platen, has a pitch circle whose diameter equals a diameter of the platen. Also, one of the first gears is positioned coaxially with the rotation axis of the transfer cylinder and has a pitch circle whose diameter equals a diameter of the transfer cylinder.

Further, according to the present invention, there is provided an image-transfer apparatus having the above constitution wherein the distance measured along a pitch circle between a surface of the tooth of one of the first gears and a surface of a tooth of the other of the first gears, which surfaces are to be brought into contact first, is 70 μm of less when a printing pressure starts to work by a contact of a platen surface and a transfer cylinder surface after the platen and the transfer cylinder rotate with their cut-off portions facing each other.

Furthermore, according to the present invention, there is provided an image-transfer apparatus having the above described constitution, wherein the image-transfer apparatus further has at least two second gears between the two first gears positioned coaxially with the platen and transfer cylinder. The rotational-axial center of one second gear, engaged in the first gear positioned coaxially with the rotation axis of the platen or transfer cylinder provided with the printing pressure adjusting means for movement adjustment, is positioned on an imaginary line formed by connecting the rotational axial center of the platen and the rotation-axial center of the transfer cylinder.

Further, according to the present invention, there is provided an image-transfer apparatus having the above constitution, wherein the distance measured along a pitch circle between a surface of a tooth of one of the first gears, which is positioned coaxially with the platen or transfer cylinder provided with the printing pressure adjusting means for movement adjustment, and a surface of a tooth of one of the second gears, which is engaged in the above first gear positioned coaxially with the rotation axis of the platen or transfer cylinder provided with the printing pressure adjusting means for movement adjustment, which surfaces are brought into contact first, is 70 μm of less when a printing pressure starts to work by contact of a platen surface and a transfer cylinder surface after the platen and the transfer cylinder rotate with their cut-off portions facing each other.

Moreover, according to the present invention, there is provided an image-transfer apparatus having a platen and a transfer cylinder, one of which is provided with an actuation means. The platen or transfer cylinder which is not provided with the above actuation means has a rotation load imparting means.

Further, according to the present invention, there is provided an image-transfer apparatus having a platen and a transfer cylinder, one of which is provided with an actuation means. The platen or transfer cylinder which is not provided with the above actuation means has a greater effective circumferential length than the platen or transfer cylinder which is provided with the above actuation means, and the difference in circumferential length is 1.0% of less.

DETAILED DESCRIPTION OF THE INVENTION

The present invention will be explained in detail by reference to the drawings.

Figure 1:
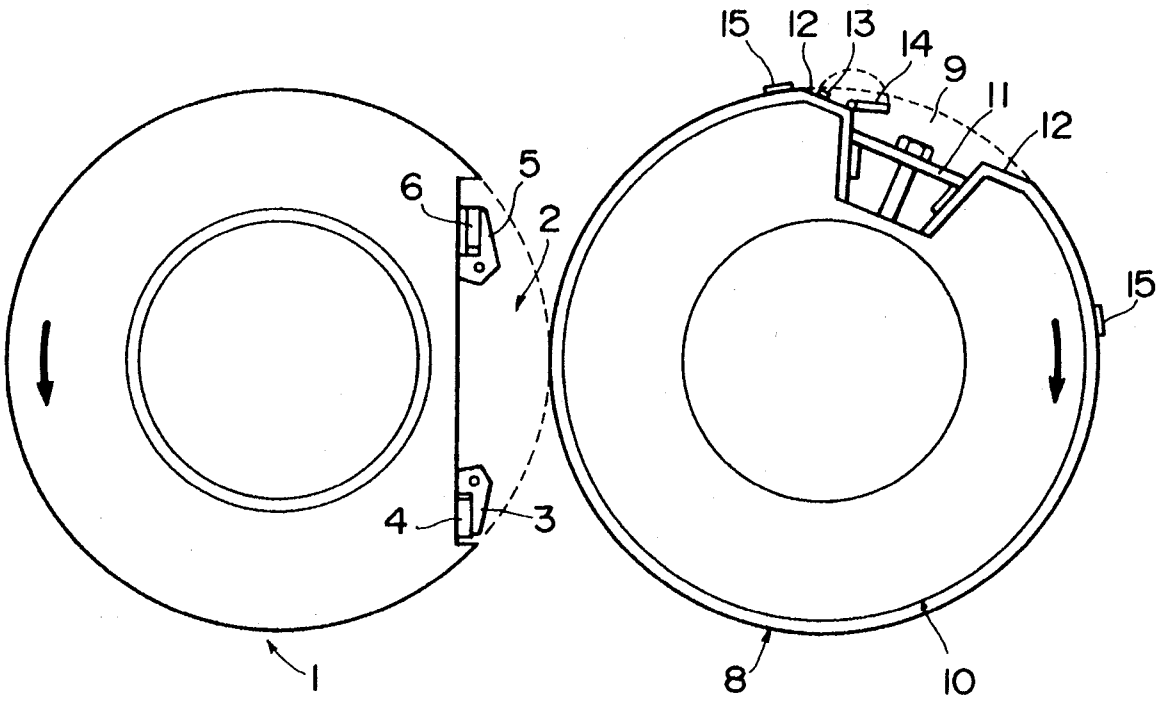
FIG. 1 is a schematic cross-sectional view of an image-transfer apparatus.

FIG. 1 schematically shows an image-transfer apparatus suitable for use in the present invention. The surface of a transfer cylinder 1 is provided with a partial cut-off portion 2, and the partial cut-off portion 2 is provided with a clamp (top end clamp) consisting of a holder 3 for holding the top end side of an image receptor (not shown) and a holder seat 4 and a clamp (bottom end clamp) consisting of a holder 5 for holding the bottom end of the image receptor and a holder seat 6. An image receptor such as a paper sheet is attached to the transfer cylinder by allowing the top end clamp to hold the top end side of the image receptor, turning the transfer cylinder in the direction of an arrow while the image receptor is tensioned, and allowing the bottom end clamp to hold the bottom end side of the image receptor.

In FIG. 1, numeral 8 indicates a platen. The platen 8 is provided with a partially cut-off portion 9. The surface of the platen 8 is wrapped with a blanket 10, and the top and bottom end sides of the blanket 10 are fixed within the partial cut-off portion with a blanket fixing means 11. The partial cut-off portion 9 has two slope portions 12 extending to a platen surface (circumferential surface), and one slope portion is provided with a pin bar 13 formed of iron. The pin bar 13 is pressed on a platen surface with the blanket 10, which has holes in places corresponding to pin positions of the pin bar 13. The pin bar 13 has so small a height that its top does not protrude over the circumferential surface of the platen 8. Thus the pin bar and the surface of the transfer cylinder 1 are not damaged in the rotation of the platen 8 and the transfer cylinder 1. A magnet sheet 14 may be tiltably attached within the partial cut-off portion 9 with the attached side being pivotally mounted. An adhesive tape 15 is provided on a platen surface near the slope portion where the pin bar 13 is located, and another adhesive tape 15 is also provided on a platen surface near the other slope portion. The magnet sheet 14 is not so wide as to reach the former adhesive tape 15, but is so wide as to cover the pin bar 13 when the magnet sheet is tilted toward the pin bar 13. An image-forming material has holes corresponding to pins of the pin bar 13, and the holes are located in the top end side of the image-forming material. These holes are fit to the pins of the pin bar 13, and the image-forming material is retained with the magnet sheet. Then, the platen 8 is turned, and the top side of the image-forming material is fixed with the adhesive tape 15, followed by fixing the bottom side of the image-forming material with the other adhesive tape 15.

When the image receptor is attached or removed or when tile image-forming material is attached or removed, the transfer cylinder 1 and the platen 8 are independently turned by actuation means which are independently provided with the transfer cylinder 1 and the platen 8. An image formed in the image-forming material is transferred to an image receptor under an adjusted printing pressure by rotating the platen 8, to which the image-forming material is attached, and the platen, to which the image receptor is attached.

Figure 2:
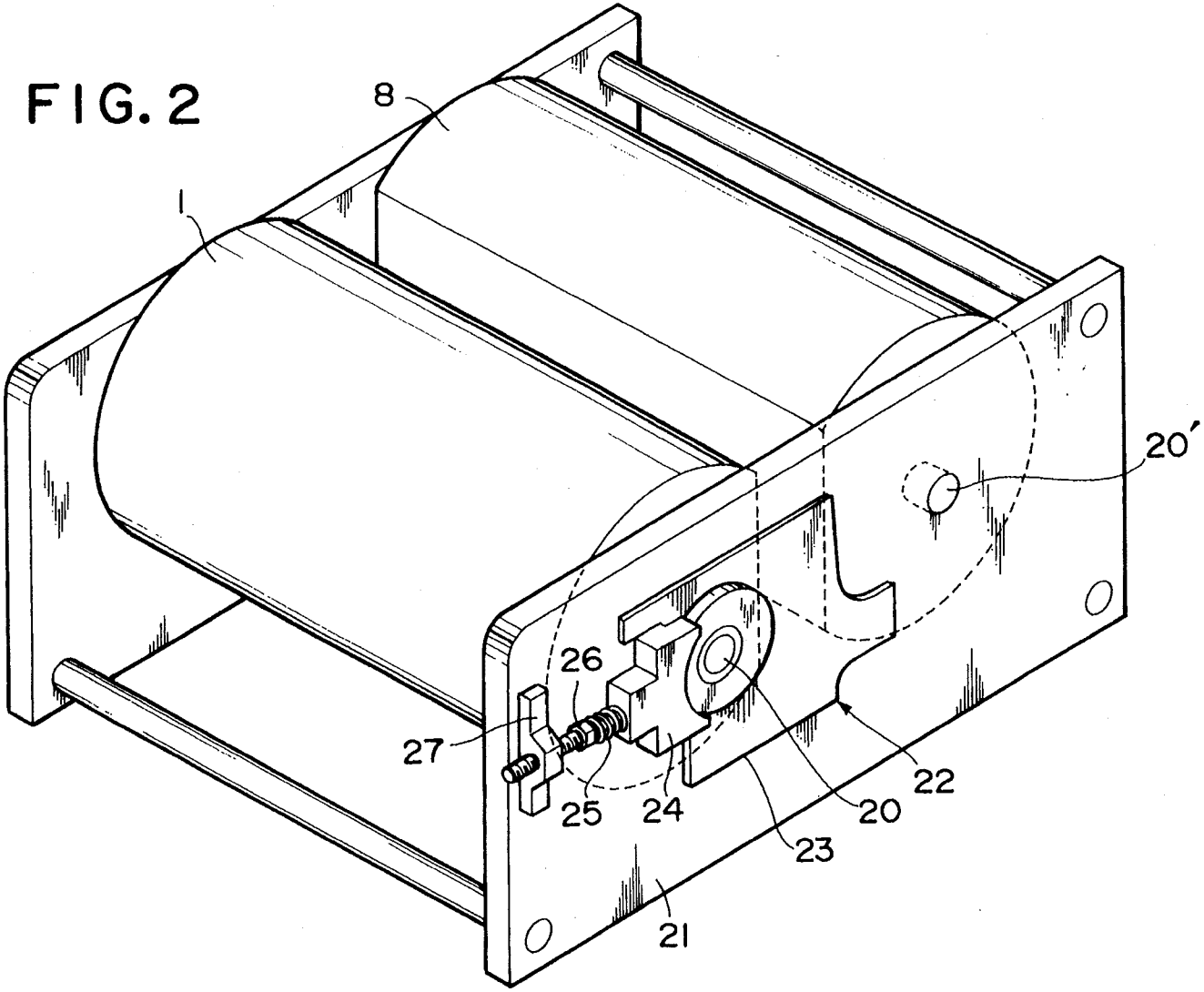
FIG. 2 is a schematic cross-sectional view of a printing pressure adjusting means.

FIG. 2 shows one embodiment of a printing pressure adjusting means 22 (for adjusting the printing pressure between the transfer cylinder and the platen). The transfer cylinder 1 is supported on a rotation shaft 20 and the platen 8 is supported on a rotation shaft 20'. These rotation shafts 20 and 20' are supported by side frames 21. In FIG. 2, one printing pressure adjusting means 22 is provided on one end surface side of the transfer cylinder 1, and one other printing pressure adjusting means (not shown) is provided on the other end surface side of the transfer cylinder 1. The printing pressure adjusting means may be provided toward surfaces of the platen 8. A slide block 23 is provided on the side frame, and one other slide block (not shown) is provided on the other side frame. A combination of these slide blocks work to adjust the printing pressure uniformly in the shaft direction. Each slide block 23 is provided with a moving means for moving the slide block to and from the platen for keeping constant the printing pressure between the platen and the transfer cylinder. The moving means comprises a spring (elastomer) receptor 24 attached to the slide block 23, a coil spring (elastic member) 25 for pressing the spring receptor toward the slide block side, an adjusting bolt 26 for properly adjusting the elastic strength of the coil spring and an adjusting bolt receptor 27 for fixing one end of the moving means to the side frame. The above coil spring may be replaced with other elastic members, such as a plate spring, a leaf spring, or the like. Further, other hydraulic or pneumatic means may be employed instead of the elastic member. Owing to the above printing pressure adjusting means, the transfer cylinder (or the platen) is always in a state in which the transfer cylinder (or the platen) is pressed toward the platen (or the transfer cylinder).

The present inventors have made studies to find what causes the poor registering accuracy in multi-color printing, and have found the following. When one of the platen and the transfer cylinder is turned with an actuation means and tile other is frictionally rotated at a transfer step, an image to be transferred, i.e., a non-cured portion of an image-forming material, is liable to slip. When the gear positioned coaxially with the platen and the gear positioned coaxially with the transfer cylinder are actuated through at least two second gears (an even number of gears), at least one second gear that is engaged in tile first gear coaxially positioned with the platen or the transfer cylinder is required to be positioned so that the center of rotation axis of the second gear is on an imaginary line formed by connecting the center of rotation axis of the platen and the center of rotation axis of the transfer cylinder. The reason therefor is as follows. When the center of rotation axis of the second gear is out of the imaginary line, a rotational force works on the first gear coaxially positioned with the platen or the transfer cylinder when the platen or the transfer cylinder is moved by means of the printing pressure adjusting means, whereby the registering accuracy is made poor. The present inventors have also found that further excellent registering accuracy is accomplished when the distance measured along a pitch circle between a surface of a tooth of one of the first gears and a surface of a tooth of the other of the first gears, which surfaces are to be brought into contact first, is within a predetermined range, i.e., 70 μm or less, when a printing pressure starts to work by a contact of a platen surface and a transfer cylinder surface after the platen and the transfer cylinder rotate with their cut-off portions facing each other.

It has been further found that the registering accuracy improves, for example, by providing the platen with a rotation load imparting means (i.e., a means which exerts a load on the rotation of the platen when the transfer cylinder is rotated by the actuation means to rotate the platen by the contact of the gears). When the transfer cylinder and the platen are turning with their cut-off portions facing each other, the platen turns excessively by inertia, etc., to make unstable the mutual contact of the gear provided on the transfer cylinder and the gear provided on the platen. In this case, when the transfer is initiated while the platen and the transfer cylinder are in contact, the transfer position varies to impair the registering accuracy. The rotation load imparting means is effective for preventing tile above drawbacks.

Further, tile present inventors have found the following. When, for example, the transfer cylinder is rotated by the actuation means to rotate the platen by the contact of the gears, and when the effective circumferential length of the platen is greater than the effective circumferential length of the transfer cylinder by 1.0% or less, the registering accuracy is not affected. The term "effective circumferential length" refers to a distance at which one point of the surface of the platen or the transfer cylinder moves (rotates) with regard to one rotation angle when the platen and the transfer cylinder are turning with printing pressure. For example, when a platen or transfer cylinder having an elastomer such as a blanket on its surface is rotated under pressure, the elastomer undergoes elastic deformation, and due to the elastic deformation in a nip portion, the length of movement of one point of the surface is smaller than the value calculated on the basis of a diameter when no elastic deformation occurs.

The performance of the present invention will be explained hereinafter.

Figure 3:
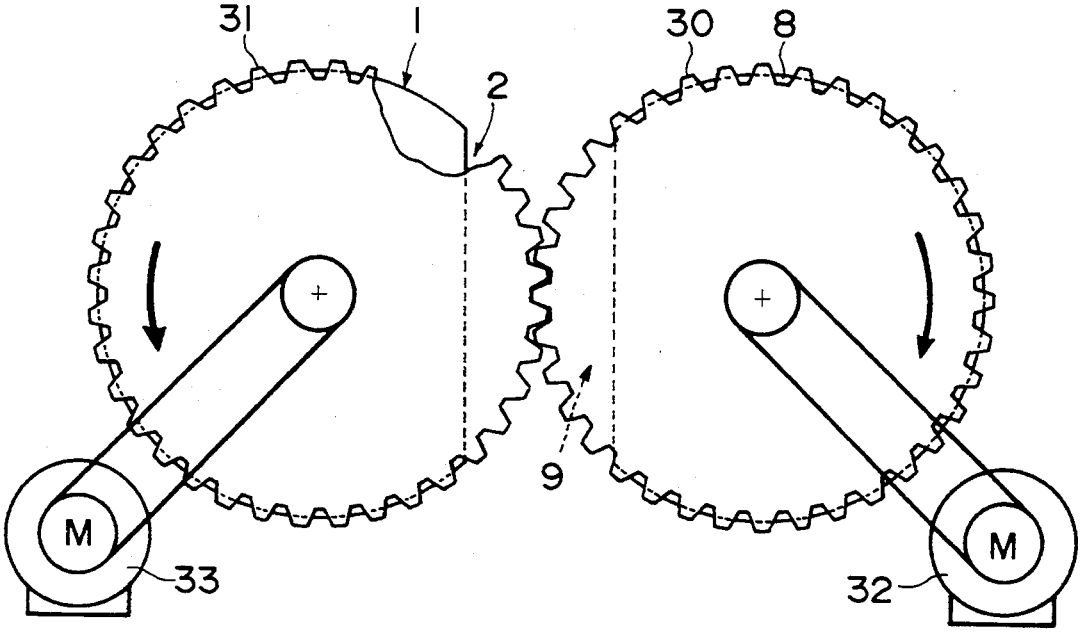
FIG. 3 is a schematic cross-sectional view of an image-transfer apparatus equipped with gears, one of which has a rotation axis coaxial with the rotation axis of a platen and the other of which has a rotation axis coaxial with the rotation axis of a transfer cylinder.

FIG. 3 schematically shows an image transfer apparatus comprising two gears 30 and 31 and motors 32 and 33. Each of the gears 30 and 31 are coaxially positioned with a platen 8 or a transfer cylinder 1, and their pitch circles have the same diameter as that of tile platen and the transfer cylinder. The gear 30 and the platen 8 are connected or disconnected with a clutch (not shown), the gear 31 and the transfer cylinder 1 are connected or disconnected with a clutch (not shown), the gear 30 and the motor 32 are connected or disconnected with a clutch (not shown), and the gear 31 and the motor 33 are connected or disconnected with a clutch (not shown). The gear 30 and the gear 31 are constantly engaged in each other. For attaching an image receptor to the transfer cylinder 1, the gear 31 is actuated to turn by means of the motor 33. In this case, the gear 30 and the motor 32 are disconnected with the clutch, and the gear 30 and the platen 8 are disconnected with the clutch. For attaching an image-forming material to the platen 8, the platen 8 is actuated to turn by means of the motor 32. In this case, the gear 31 and the motor 33 are disconnected with the clutch, and the gear 31 and the transfer cylinder 1 are disconnected with the clutch. For transferring an image from the image-forming material to the image receptor, for example, when the transfer cylinder 1 is actuated to turn by means of the motor 33, the motor 32 and the gear 30 alone are disconnected so that the transfer cylinder 1 and the platen 8 are turned so as to be synchronized, whereby the image-,forming material and the image receptor do not slip on each other, and poor registering is prevented. Further, when the transfer cylinder 1 is provided with a printing pressure adjusting means to move the transfer cylinder 1, the degree of engagement between the gears 31 and 30 is low due to the pressure applied for generating printing pressure. When the degree of the engagement is low, a gap occurs between tooth surfaces that are to be brought into contact. This gap generates positional deviation between the transfer cylinder 1 and the platen 8 at an initial time of actuation, causing poor registering of the an image that is obtained. Therefore, the present invention brings the so-generated inter-tooth gap into a predetermined value range. The gap control is accomplished by controlling the sizes of the angle formed by a tooth base (bottom) surface to a tooth slope, the curved form of a tooth surface and the distance between the gear 31 and the gear 30. The distance between the gear 31 and the gear 30 can be adjusted by employing proper means, such as selection of the elastic force of the coil spring of the printing pressure adjusting means explained in FIG. 1 and selection of the elastic force of the blanket explained in FIG. 1.

Figure 4:
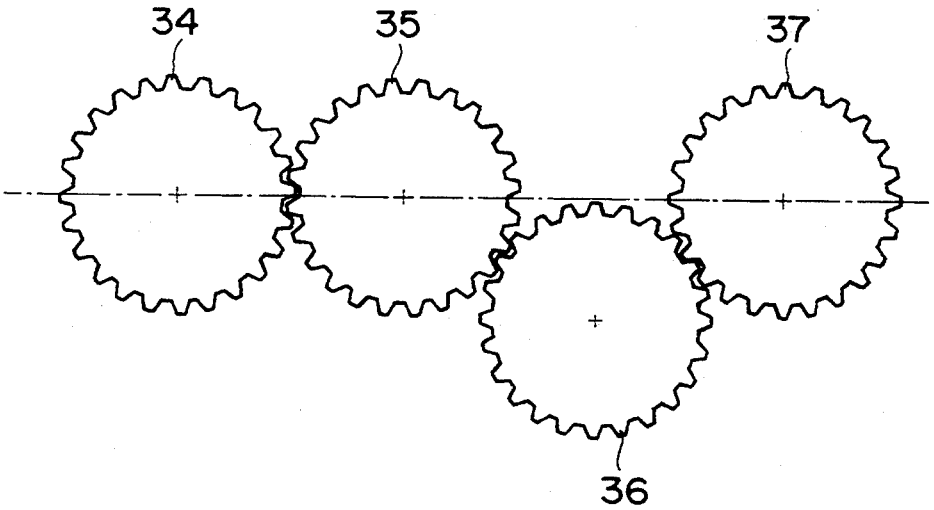
FIG. 4 is a schematic view of the alignment of gears.

FIG. 4 shows one embodiment of gear arrangement according to the present invention. A gear 35 engaged in a gear 34 coaxially positioned with the rotation-axial center of a platen or a transfer cylinder which is moved by a printing pressure adjusting means is positioned on an imaginary line connecting the rotation-axial centers of the platen and the transfer cylinder. The transfer cylinder or the platen is moved by the printing pressure adjusting means on the imaginary line connecting the rotation-axial centers of the gears 34, 35 and 37, whereby tile generation of a rotation force from tile gear 35 to the gear 34 when the gear 35 is out of the line does not take place, and the poor registering is prevented. In the gear arrangement shown in FIG. 4, the gap between the surfaces of the gears 34 and 35 is arranged to be 70 μm or less when a printing pressure starts to work by a contact of a platen surface and a transfer cylinder surface after the platen and the transfer cylinder rotate with their cut-off portions facing each other. As a result, the positional deviation between the transfer cylinder and the platen is maintained within a predetermined range, and a transfer image having a satisfactory registering accuracy is provided.

Figure 5:
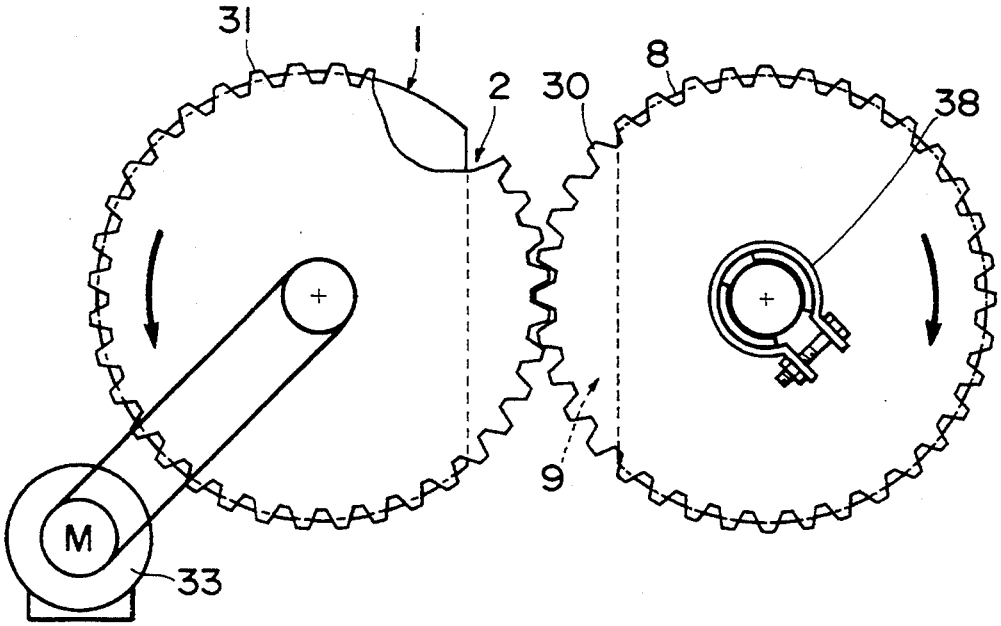
FIG. 5 is a schematic view of an image-transfer apparatus having a platen equipped with a rotation load imparting means.

FIG. 5 schematically shows one embodiment of an image transfer apparatus provided with a brake 38, which is a rotation load imparting means of the present invention. FIG. 5 shows a case where the apparatus is actuated with a motor 33 on the transfer cylinder 1 side.

When an image is transferred from an image-forming material to an image receptor, a transfer cylinder 1 is actuated by means of a motor 33 with connecting a gear 30 and a platen 8, and the transfer cylinder I and the platen 8 are synchronization-rotated from a state where the transfer cylinder 1 and the platen 8 are not in contact with each other wit[, cut-off portions 2 and 9 facing each other. Then, the surface of the transfer cylinder 1 and the platen are brought into contact to form a nip and carry out the image transfer. In this case, a load in the rotation direction is applied to the platen 8 by the function of the brake 8, and the rotation is transferred without generating a gap between a surface of tooth of the gear 30 and a surface of tooth of the gear 31, whereby the positional relationship between the transfer cylinder 1 and the platen 8 is maintained constant even in a state when the transfer cylinder 1 and the platen 8 are turning with the cut-off portions 2 and 9 facing each other before the surfaces of the cylinder and the platen come into contact. When the transfer cylinder 1 and the platen 8 are turning with the cut-off portions 2 and 9 facing each other, the platen 8 sometimes turns excessively by inertia due to the absence of the brake 38, and the tooth of the gear 30 and the tooth of the gear 31 sometimes come into unstable contact. When the transfer is initiated by bringing the surfaces of the transfer cylinder and the platen into contact after such a state is generated, the transfer position varies, and the registering accuracy in multi-color image transfer is badly impaired.

In the above embodiment, the transfer cylinder 1 is actuated by the motor 33, which is an actuation means, and the platen is synchronizingly turned through the gears 30 and 31. When the platen is actuated by a motor to turn the transfer cylinder through gears, the transfer cylinder is provided with the rotation load imparting means.

Figure 6:
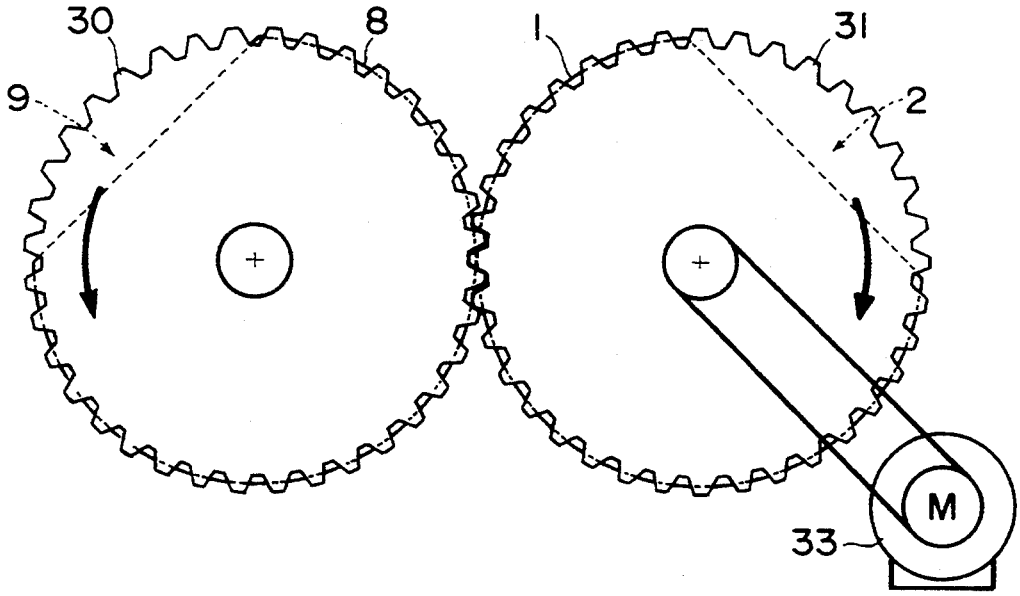
FIG. 6 is a schematic view of an image-transfer apparatus in which the effective circumferential length of a transfer cylinder and the effective circumferential length of a platen are equal to each other.
Figure 7:
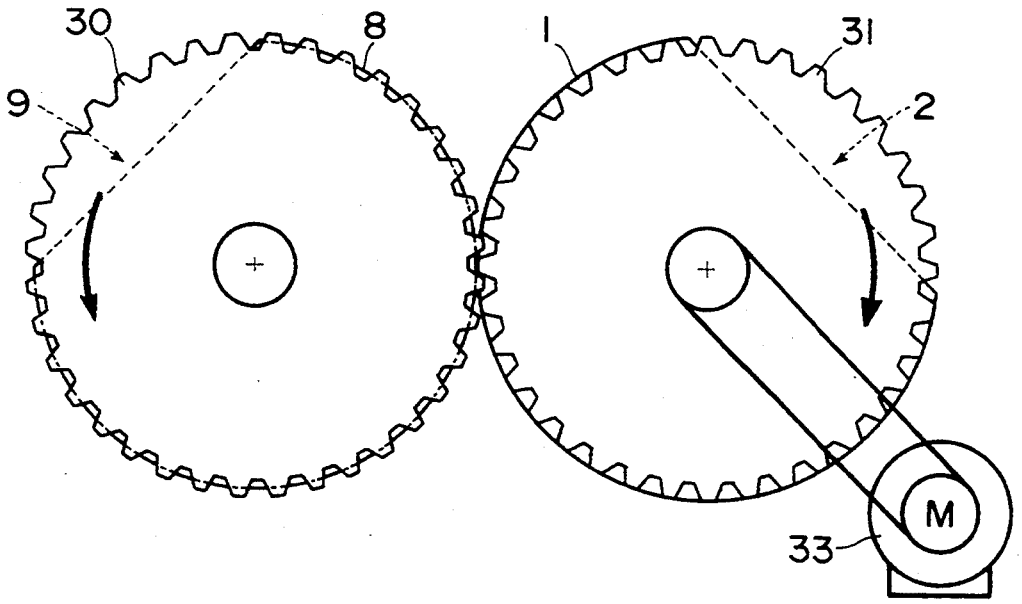
FIG. 7 is a schematic view of an image-transfer apparatus in which the effective circumferential length of a transfer cylinder is greater than the effective circumferential length of a platen.
Figure 8:
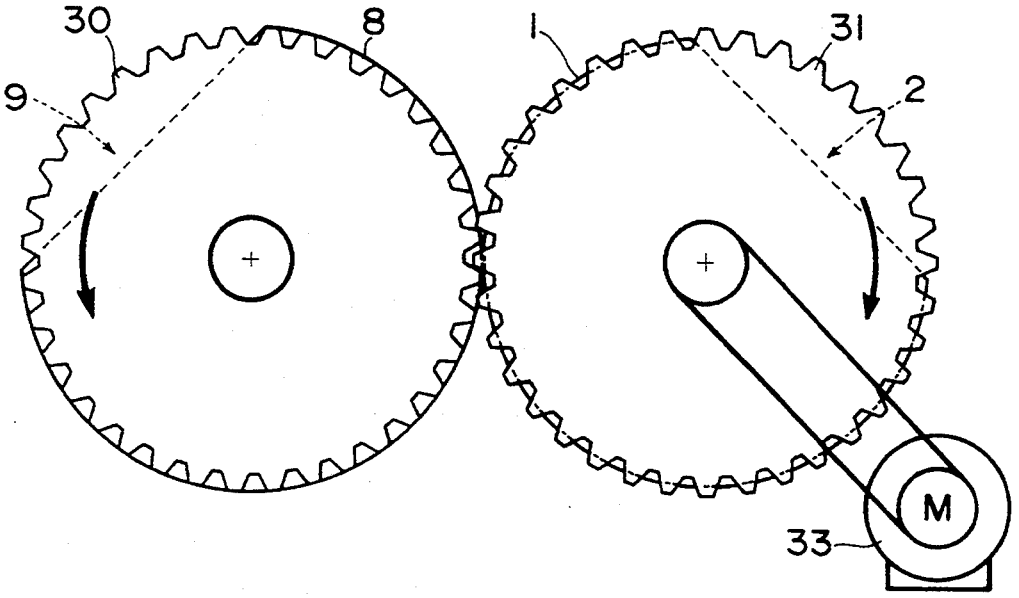
FIG. 8 is a schematic view of an image-transfer apparatus in which the effective circumferential length of a transfer cylinder is smaller than the effective circumferential length of a platen.

FIGS. 6, 7 and 8 explain the performance depending upon the effective circumferential length.

FIG. 6 shows an example in which the effective circumferential length of a transfer cylinder 1 equals the effective circumferential length of a platen 8. In this example, the degree of rotation transmitted from a gear 31 to a gear 30 equals the degree of rotation generated by contact friction in a nip portion where the transfer cylinder and the platen come into contact, and no rotation deviation caused by sliding occurs.

FIG. 7 shows an example in which the effective circumferential length of a platen 8 is smaller than the effective circumferential length of a transfer cylinder 1. In this example, the degree of rotation of the platen 8, caused by contact friction in a nip portion, is greater than the degree of rotation of a gear 31. As a result, a gap is formed between the surface of a tooth of a gear 30 and the surface of a tooth of the gear 31, and the gap broadens. Therefore, the driving force cannot be transmitted from the gear 31 to the gear 30, which results in turning the platen 8 by contact friction in a nip portion. And, an uncured portion of an image-forming material may slip, and no sufficient registering accuracy is obtained.

FIG. 8 shows an example in which the effective circumferential length of a platen 8 is greater than the effective circumferential length of a transfer cylinder 1. In this example, the degree of rotation of a platen 8, caused by contact friction in a nip portion, is smaller than the degree of rotation of a gear 31, and as a result, the platen is turned by means of a driving force from the gear while forcibly making the nip portion slide. In this case, when the effective circumferential length of the platen 8 is much greater than that of the transfer cylinder 1, the amount of sliding in the nip portion increases, and an unnatural force is exerted on an image-forming material to have an adverse effect on the registering accuracy. When the difference in the effective circumferential length is as sufficiently small as 1.0% or less, preferably 0.5% or less, the platen and the transfer cylinder can be turned without causing any vital adverse effects on the registering accuracy, but causing stable sliding.

According to the present invention, there is provided an image transfer apparatus which is free from poor registering accuracy and which can give an aesthetically fine multi-colored prepress proof or a multi-colored image.

What is claimed is:

1. An image-transfer apparatus, comprising:

a frame;

a platen having a rotation shaft rotatably supported by said frame and located on a rotation axis, a surface and a cut-off portion on said surface, whereby said platen can receive an image-forming material;

a transfer cylinder having a rotation shaft rotatably supported by said frame and located on a rotation axis, a surface and a cut-off portion on said surface, whereby said transfer cylinder can receive an image receptor;

wherein said platen and said transfer cylinder form a nip portion therebetween for the introduction of the image-forming material and the image receptor into said nip portion by rotation of said platen and said transfer cylinder to transfer an image formed in a photosensitive layer of the image-forming material to the image receptor;

a printing pressure adjusting means for pressing one of said platen and said transfer cylinder towards the axial center of the other of said platen and said transfer cylinder, said printing pressure adjusting means comprising a slide block slidable on said frame and a pressing means for elastically pressing said slide block toward the axial center of the other of said platen and said transfer cylinder with a constant force, said pressing means comprising an elastic member;

two first gears connected with said platen and said transfer cylinder, respectively, and an actuator means for rotating said gears, said platen and said transfer cylinder, said two first gears being rotatably connected with each other, one of said two first gears being positioned coaxially with said platen, and the other of said two first gears being positioned coaxially with said transfer cylinder.

2. The apparatus of claim 1, wherein the one and the other of said first two gears have pitch circle diameters equalling diameters of said platen and said transfer cylinder, respectively.

3. The apparatus of claim 2, wherein a distance, measured along a pitch circle, between a surface of a tooth of the one of said two first gears and a surface of a tooth on the other of said two first gears, which surfaces are to be brought into contact first, is 70 μm or less when printing pressure occurs by contact between said surface of said platen and said surface of said transfer cylinder upon rotation thereof from a position in which said cut-off portion of said platen faces said cut-off portion of said transfer cylinder.

4. The apparatus of claim 1, and further comprising two second gears located between and rotatably connecting said two first gears, wherein one of said two second gears is engaged with the one of said two first gears that is positioned coaxially with the one of said platen and said transfer cylinder that has said printing pressure adjusting means pressing it toward the other of said platen and said transfer cylinder, the one of said two second gears having an axial rotation center that is positioned on an imaginary line formed by the axial rotation center of said platen and the axial rotation center of said transfer cylinder.

5. The apparatus of claim 4, wherein a distance, measured along a pitch circle, between a surface of a tooth of the one of said two first gears that is positioned coaxially with the one of said platen and said transfer cylinder that has said printing pressure adjusting means pressing it toward the other of said platen and said transfer cylinder and a surface of a tooth on the one of said two second gears that is engaged with the one of said two first gears that is positioned coaxially with the one of said platen and said transfer cylinder that has said printing pressure adjusting means pressing it toward the other of said platen and said transfer cylinder, which surfaces are to be brought into contact first, is 70 μm or less when printing pressure occurs by contact between said surface of said platen and said surface of said transfer cylinder upon rotation thereof from a position in which said cut-off portion of said platen faces said cut-off portion of said transfer cylinder.

6. The apparatus of claim 1, wherein one of said platen and said transfer cylinder is provided with said actuator means, and the other of said platen and said transfer cylinder is provided with a means for imparting a rotation load thereto.

7. The apparatus of claim 6, wherein said means for imparting a rotation load comprises a brake provided on said rotation shaft of the other of said platen and said transfer cylinder.

8. The apparatus of claim 1, wherein one of said platen and said transfer cylinder is provided with said actuator means, and the other of said platen and said transfer cylinder has an effective circumferential length that is greater than that of the one of said platen and said transfer cylinder that is provided with said actuator means by no more than 1%.

9. An image-transfer apparatus, comprising:

a frame;

a platen having a rotation shaft rotatably supported by said frame and located on a rotation axis, a surface and a cut-off portion on said surface, whereby said platen can receive an image-forming material;

a transfer cylinder having a rotation shaft rotatably supported by said frame and located on a rotation axis, a surface and a cut-off portion on said surface, whereby said transfer cylinder can receive an image receptor;

wherein said platen and said transfer cylinder form a nip portion therebetween for the introduction of the image-forming material and the image receptor into said nip portion by rotation of said platen and said transfer cylinder to transfer an image formed in a photosensitive layer of the image-forming material to the image receptor;

a printing pressure adjusting mechanism comprising a slide block slidable on said frame and an elastic member elastically biasing said slide block, said slide block being engaged with one of said platen and said transfer cylinder for pressing the one of said platen and said transfer cylinder toward the other of said platen and said transfer cylinder;

two first gears connected with said platen and said transfer cylinder, respectively, and an actuating motor connected with one of said gears, said two first gears being rotatably connected with each other, one of said two first gears being positioned coaxially with said platen, and the other of said two first gears being positioned coaxially with said transfer cylinder.

10. The apparatus of claim 9, wherein the one and the other of said first two gears have pitch circle diameters equalling diameters of said platen and said transfer cylinder, respectively.

11. The apparatus of claim 10, wherein a distance, measured along a pitch circle, between a surface of a tooth of the one of said two first gears and a surface of a tooth on the other of said two first gears, which surfaces are to be brought into contact first, is 70 μm or less when printing pressure occurs by contact between said surface of said platen and said surface of said transfer cylinder upon rotation thereof from a position in which said cut-off portion of said platen faces said cut-off portion of said transfer cylinder.

12. The apparatus of claim 9, and further comprising two second gears located between and rotatably connecting said two first gears, wherein one of said two second gears is engaged with the one of said two first gears that is positioned coaxially with the one of said platen and said transfer cylinder that has said printing pressure adjusting mechanism adjusting the pressure thereof against the other of said platen and said transfer cylinder, the one of said two second gears having an axial rotation center that is positioned on an imaginary line formed by the axial rotation center of said platen and the axial rotation center of said transfer cylinder.

13. The apparatus of claim 12, wherein a distance, measured along a pitch circle, between a surface of a tooth of the one of said two first gears that is positioned coaxially with the one of said platen and said transfer cylinder that has said printing pressure adjusting mechanism adjusting the pressure thereof against the other of said platen and said transfer cylinder and a surface of a tooth on the one of said two second gears that is engaged with the one of said two first gears that is positioned coaxially with the one of said platen and said transfer cylinder that has said printing pressure adjusting mechanism adjusting the pressure thereof against the other of said platen and said transfer cylinder, which surfaces are to be brought into contact first, is 70 $\mu$m or less when printing pressure occurs by contact between said surface of said platen and said surface of said transfer cylinder upon rotation thereof from a position in which said cut-off portion of said platen faces said cut-off portion of said transfer cylinder.

14. The apparatus of claim 9, wherein one of said platen and said transfer cylinder is provided with said actuating motor, and the other of said platen and said transfer cylinder is provided with a rotation load imparting mechanism.

15. The apparatus of claim 14, wherein said rotation load imparting mechanism comprises a brake provided on said rotation shaft of the other of said platen and said transfer cylinder.

16. The apparatus of claim 9, wherein one of said platen and said transfer cylinder is provided with said actuating motor, and the other of said platen and said transfer cylinder has an effective circumferential length that is greater than that of the one of said platen and said transfer cylinder that is provided with said actuating motor by no more than 1%.

* * * * *